United States Patent [19]

ter Braak

[11] 3,949,970

[45] Apr. 13, 1976

[54] MIXER

[75] Inventor: Johannes Gerardus ter Braak, Schiedam, Netherlands

[73] Assignee: Gebrs. ter Braak B.V., Rotterdam, Netherlands

[22] Filed: Jan. 2, 1974

[21] Appl. No.: 430,143

[52] U.S. Cl. ..... 259/4 AB; 239/432; 239/488

[51] Int. Cl.[2] ..... B01F 5/00

[58] Field of Search ..... 259/4, DIG. 30; 138/42, 138/43; 239/488, 432; 261/78 A, DIG. 16

[56] References Cited

UNITED STATES PATENTS 1,874,002 8/1932 Fantz ..... 239/432 X 2,254,587 9/1941 Williams ..... 138/42 X

FOREIGN PATENTS OR APPLICATIONS 128,279 5/1950 Sweden ..... 259/104

*Primary Examiner*—Harvey C. Hornsby
*Assistant Examiner*—Alan Cantor
*Attorney, Agent, or Firm*—Snyder, Brown and Ramik

[57] ABSTRACT

As in-line mixer for fluids, comprising an elongated open-ended, hollow tube and stationarily positioned therein two or more elongated, helically twisted and interengaging strips which are tightly enclosed by the tube.

6 Claims, 4 Drawing Figures

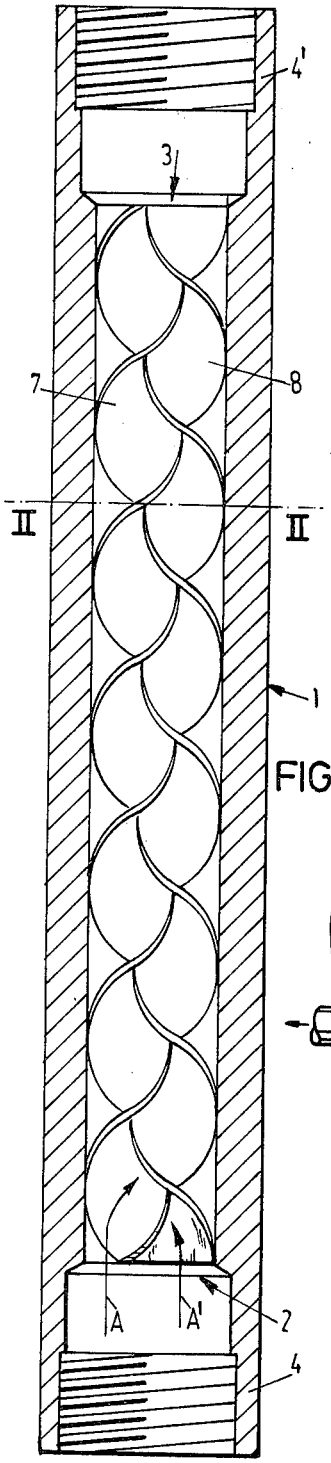
FIG.1
FIG.2
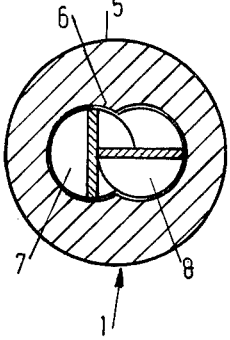
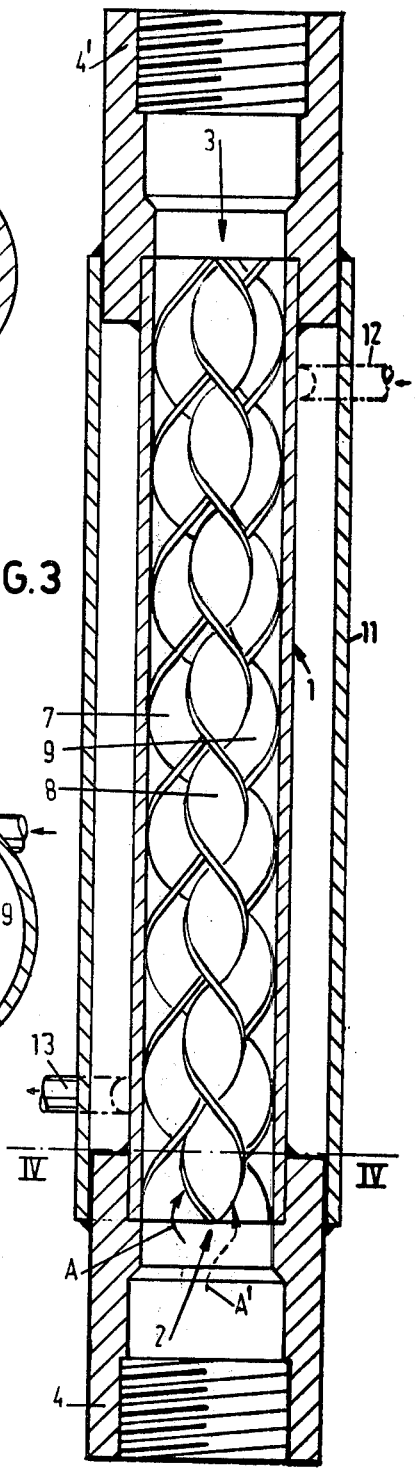
FIG.3
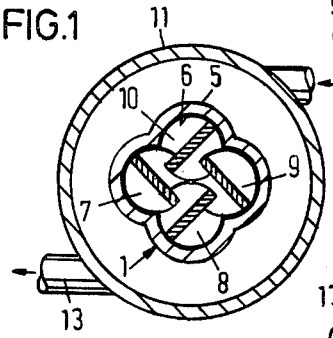
FIG.4

MIXER

This invention relates to apparatus for mixing two or more fluids, such as liquids, gases, pastes or the like, and has for its object to provide an apparatus of this kind which has an excellent mixing action whilst being simple of construction and easy to clean.

The invented apparatus comprises an elongated hollow tube having uncovered inlet and outlet ends and having positioned stationary within the tube two or more elongated, helically twisted strips which lie side by side in such a way that their twisted portions engage each other and that they are tightly enclosed by the tube.

Such an apparatus, while being simple of construction, has a high mixing efficiency. When two or more fluids, such as two liquids or a liquid and a gas or the like, are passed together through the tube, the fluid streams will repeatedly be divided into partial streams which are by-passed, accelerated, retarded, combined and again divided and brought together. Thanks to the interengaging portions of the helically twisted strips. As a consequence, there results an especially extensive mixing and kneading operation which leads to the formation of a homogeneous mixture in a relatively short length of the mixer. The pressure drop along the device is small and it can simply be cleaned by passing cleaning fluids through it. When maintenance is due, the device may easily be dismantled.

Some embodiments of the invented apparatus will now be described in further detail with reference to the accompanying drawings which are only given by way of example.

FIG. 1 is a longitudinal section through a first embodiment.

FIG. 2 is a cross-section along the line II—II of FIG. 1.

FIG. 3 is a longitudinal section through a second embodiment.

FIG. 4 is a cross-section along the line IV—IV of FIG. 3.

The embodiment of FIGS. 1 and 2 comprises an elongated hollow tube 1, e.g. of stainless steel or of a transparent rigid synthetic resin. The tube has an uncovered inlet end 2 and an uncovered outlet end 3. The ends are each provided with an internally threaded sleeve 4,4' for connection with pipelines and other devices. In cross-section (FIG. 2), the outer circumference of the tube 1 is circular and the inner circumference 6 is 8-shaped, the latter merging into a circular shape at the ends of the tube.

Positioned stationary within the tube are two elongated helically twisted strips 7 and 8, made e.g. from metal. One of these strips (7) is twisted left-hand and the other (8) is twisted right-hand. The twisted strips extend, lying side by side, over the whole effective length of the tube 1 and include in cross-section an angle of 90° (FIG. 2). Moreover, their twisted portions are interengaged in such a way that they are substantially touching each other (FIG. 2).

The helically twisted strips 7,8 are tightly enclosed by the tube 1 so as to leave substantially no clearance between the strips 7,8 and the inner circumference 6 of the tube. In order to reach this situation, the centre distance between the two circles forming the 8-shaped inner circumference of the tube (FIG. 2) has been chosen to be only slightly more than half the diameter of these circles plus once the material thickness of the strips 7,8 as used.

The mixer may be manufactured by first sliding one of the twisted strips (e.g. strip 7) into the tube and then introducing the other twisted strip (e.g. strip 8) by screwing it into its place.

During operation of this embodiment, two or more fluids such as two liquids or gases or a liquid and an gas or a paste with a thin-flowing liquid and/or a gas, are fed to the mixer through its inlet end 2 and after having passed the whole mixer, are discharged through the outlet end 3. The transmission through the mixer may be effected by pumping or by suction. When passing through the mixer, the fluid streams will repeatedly strike the edges of the twisted strips and will be divided into partial streams thereby. The partial streams will follow their own way, taking left-hand turns and right-hand turns respectively (compare the arrows A,A' in FIG. 1). During this flow, the partial streams will be exposed to retarding and accelerating influences by means of enlargements and constructions in their paths and moreover, they will repeatedly be forced from the inside to the outside and from the outside to the inside of the available space where two partial streams meet each other, they are combined and where a combined stream impinges on the edge of one of the strips, it is again divided into partial streams. As a result of this complicated series of phenomena, an extensive mixing and kneading operation is taking place and this operation is proceeding over the entire length of the mixer so as to cause the material leaving the mixer to be complete homogeneously mixed provided that the mixer is of sufficient length.

The minimum length of the mixer required to bring about a homogeneous mixture depends from several factors such as e.g. the nature of the substances to be mixed, the mixing ratio and the like, but may easily be determined in each particular case by experiments beforehand. In many cases, the mixer need not be any longer than about 20 to 30 centimeters when its highest internal diameter is 1 centimeter.

The embodiment of FIGS. 3 and 4 differs only slightly from the foregoing embodiment. In this case too, the apparatus comprises an elongated, hollow tube 1 having an uncovered inlet end 2 and an uncovered outlet end 3. The tube is provided with internally threaded sleeves 4,4' for connection with pipelines and other devices and further with a cooling or heating jacket 11 which has connections 12,13 for feeding and discharging a heating or cooling medium. In cross-section, the outer and inner circumferences 5 and 6 of the tube 1 are rosette-shaped whilst the connecting sleeves and the jacket have a circular shape.

Positioned stationary within the tube are four elongated, helically twisted strips 7,8,9,10 of metal or the like, which have been twisted alternately left-hand (e.g. strips 7 and 9) and right-hand (e.g. strips 8 and 10). These strips extend, lying side by side over the whole length of the tube 1 and include angles of 90° with each other in cross-section (FIG. 4). Moreover, their twisted portions strongly engage each other without, however, causing the strips to touch each other completely in cross-section (FIG. 4).

The twisted strips 7 to 10 are tightly enclosed by the tube 1 so as to leave substantially no clearance between the strips and the inner circumference 6 of the tube.

The mixer may be manufactured by pressing the four twisted strips into their interengaging position and then introducing the whole combination by a sliding movement into the tube. Thereafter, the connecting sleeves and the jacket may be positioned and fixed.

The embodiment of FIGS. 3 and 4 is used in the same way as the embodiment of FIGS. 1 and 2. Thanks to the four twisted strips, the same phenomena will occur but in an intensified way, thus causing a still more extensive mixing operation. The jacket 11 may serve to bring about a rapid cooling or heating action during operation. A rapid removal of heat generated during the mixing operation may be of advantage for substances which are heat-sensitive such as egg white emulsions.

On the other hand, a heating action of the substances during mixing may also be advantageous sometimes; thus, by heating and mixing knocked up egg white with cooked sugar, there may be obtained a toffee mass which is much more aerated than the known mixtures in this field of the art (a specific weight of 0.6 to 0.8 instead of 1.4).

The correct length of the mixer of FIGS. 3 and 4 may again be determined by previous experiments but in most cases, a length of 20 to 30 centimeters at an inner diameter of 1.5 centimeters will be suffcient.

Many variants to the embodiments as shown are possible. Thus, the tube 1 of FIGS. 3 and 4 may also have a circular inner circumference 6 in cross-section. In that case, there will be somewhat more clearance between the twisted strips and the inner circumference of the tube but this clearance may be neglected in practice. Further the embodiment of FIGS. 1 and 2 may also be provided with a cooling or heating jacket for better control of temperature during the mixing operation.

What I claim is:

1. Apparatus for mixing two or more fluids to provide extensive mixing and kneading which leads to the formation of a homogeneous mixture in a relatively short length of the apparatus while creating only a small pressure drop, comprising in combination:

an elongate casing defining a through-bore of substantially uniform cross-section throughout for at least a major extent thereof;

at least one pair of helically twisted strips in which one strip is twisted in right-hand direction whereas the other strip is twisted in left-hand direction, said strips being disposed in side-by-side nested and interfitted relation whereby to define fluid flow paths which periodically merge and then separate along the length of said strips;

said strips being housed within said casing within the section thereof which is of substantially uniform cross-section and said casing tightly enclosing said strips whereby to confine said fluid flow paths and enhance intermingling and mixing of fluids passing therethrough.

2. Apparatus as defined in claim 1 wherein said through-bore is of 8-shaped cross-section.

3. Apparatus as defined in claim 2 wherein the leading edges of said strips are disposed normal to each other.

4. Apparatus as defined in claim 1 wherein there are two pairs of oppositely twisted strips, each pair being nested and interfitted and the two pairs being in side-by-side grouping.

5. Apparatus as defined in claim 4 wherein said through-bore is of rosette configuration in cross-section.

6. Apparatus as defined in claim 5 wherein the leading edges of the strips of each pair are disposed normal to each other.

* * * * *